US011781288B2

(12) United States Patent
Nishikawara

(10) Patent No.: US 11,781,288 B2
(45) Date of Patent: Oct. 10, 2023

(54) SHOVEL

(71) Applicant: SUMITOMO CONSTRUCTION MACHINERY CO., LTD., Tokyo (JP)

(72) Inventor: Riichi Nishikawara, Chiba (JP)

(73) Assignee: SUMITOMO CONSTRUCTION MACHINERY CO., LTD., Tokyo (JP)

( * ) Notice: Subject to any disclaimer, the term of this patent is extended or adjusted under 35 U.S.C. 154(b) by 0 days.

(21) Appl. No.: 17/649,816

(22) Filed: Feb. 3, 2022

(65) Prior Publication Data

US 2022/0154429 A1 May 19, 2022

Related U.S. Application Data

(63) Continuation of application No. PCT/JP2020/030520, filed on Aug. 7, 2020.

(30) Foreign Application Priority Data

Aug. 9, 2019 (JP) ..... 2019-148139

(51) Int. Cl.
*E02F 9/22* (2006.01)
*F15B 11/08* (2006.01)

(52) U.S. Cl.
CPC ..... *E02F 9/2282* (2013.01); *E02F 9/2292* (2013.01); *E02F 9/2296* (2013.01); *F15B 11/08* (2013.01)

(58) Field of Classification Search
CPC ..... E02F 9/2235
See application file for complete search history.

(56) References Cited

U.S. PATENT DOCUMENTS 5,295,795 A * 3/1994 Yasuda ..... E02F 9/2235 60/368
5,575,148 A 11/1996 Hirata et al.
8,744,654 B2 * 6/2014 Wu ..... B60K 6/485 701/50
8,899,035 B2 * 12/2014 Nishikawa ..... E02F 9/2235 60/452
9,002,590 B2 * 4/2015 Akiyama ..... F02D 29/04 123/319
10,215,197 B2 * 2/2019 Kim ..... F15B 13/16
(Continued)

FOREIGN PATENT DOCUMENTS

JP H07-042709 2/1995
JP H11-311203 11/1999
(Continued)

OTHER PUBLICATIONS

International Search Report for PCT/JP2020/030520 dated Oct. 27, 2020.

*Primary Examiner* — Michael Leslie
(74) *Attorney, Agent, or Firm* — IPUSA, PLLC

(57) ABSTRACT

A shovel includes a lower traveling structure, an upper swing structure mounted on the lower traveling structure, an engine mounted on the upper swing structure, a hydraulic pump configured to be driven by the engine, a hydraulic actuator, an operating device configured to operate the hydraulic actuator, and a hardware processor configured to control the discharge quantity of the hydraulic pump through negative control and change a control characteristic of the negative control according to the details of an operation on the operating device.

4 Claims, 6 Drawing Sheets

(56) References Cited

U.S. PATENT DOCUMENTS

| | | | |
|---|---|---|---|
| 2011/0238264 | A1 | 9/2011 | Wu |
| 2019/0284782 | A1 | 9/2019 | Izumikawa |

FOREIGN PATENT DOCUMENTS

| | | |
|---|---|---|
| JP | 4843105 | 12/2011 |
| JP | 2012-255434 | 12/2012 |
| JP | 2014-005866 | 1/2014 |
| JP | 2015-059591 | 3/2015 |
| JP | 5889098 | 3/2016 |
| WO | 2018/105527 | 6/2018 |

* cited by examiner

SHOVEL

CROSS-REFERENCE TO RELATED APPLICATIONS

This application is a continuation application filed under 35 U.S.C. 111(a) claiming benefit under 35 U.S.C. 120 and 365(c) of PCT International Application No. PCT/JP2020/030520, filed on Aug. 7, 2020 and designating the U.S., which claims priority to Japanese Patent Application No. 2019-148139, filed on Aug. 9, 2019. The entire contents of the foregoing applications are incorporated herein by reference.

BACKGROUND

Technical Field

The present invention relates to shovels in which a negative control hydraulic system is installed.

Description of Related Art

A shovel in which a negative control hydraulic system is installed has been known. According to the negative control hydraulic system, of hydraulic oil discharged by a hydraulic pump, hydraulic oil that does not flow into hydraulic actuators for moving parts of the shovel is discharged to a hydraulic oil tank through a throttle placed in a center bypass oil conduit. The amount of discharge of the hydraulic pump is controlled according to a control pressure that is the pressure of hydraulic oil upstream of the throttle. The control pressure increases as the flow rate of hydraulic oil passing through the throttle increases. When a hydraulic actuator is operated, the flow rate of hydraulic oil flowing into the hydraulic actuator increases, and the flow rate of hydraulic oil passing through the throttle therefore decreases to reduce the control pressure. Therefore, the hydraulic pump is so controlled as to increase the amount of discharge as the control pressure decreases. This is for causing a sufficient amount of hydraulic oil to flow into the hydraulic actuator when the hydraulic actuator is operated. On the other hand, the hydraulic pump is so controlled as to decrease the amount of discharge as the control pressure increases. This is for preventing hydraulic oil from being unnecessarily discharged when no hydraulic actuator is operated.

SUMMARY

According to an embodiment of the present invention, a shovel includes a lower traveling structure, an upper swing structure mounted on the lower traveling structure, an engine mounted on the upper swing structure, a hydraulic pump configured to be driven by the engine, a hydraulic actuator, an operating device configured to operate the hydraulic actuator, and a hardware processor configured to control the discharge quantity of the hydraulic pump through negative control and change a control characteristic of the negative control according to the details of an operation on the operating device.

DETAILED DESCRIPTION

According to the negative control hydraulic system of related art, the correspondence between the amount of discharge of the hydraulic pump and the control pressure is fixed. Therefore, there may be a situation where the hydraulic pump discharges more hydraulic oil than is necessary or a situation where the hydraulic oil fails to discharge necessary hydraulic oil.

In view of the above, it is desirable to provide a shovel in which a negative control hydraulic system that can more flexibly control the discharge amount of a hydraulic pump is installed.

According to an embodiment of the present invention, a shovel in which a negative control hydraulic system that can more flexibly control the discharge amount of a hydraulic pump is installed can be provided.

Figure 1:
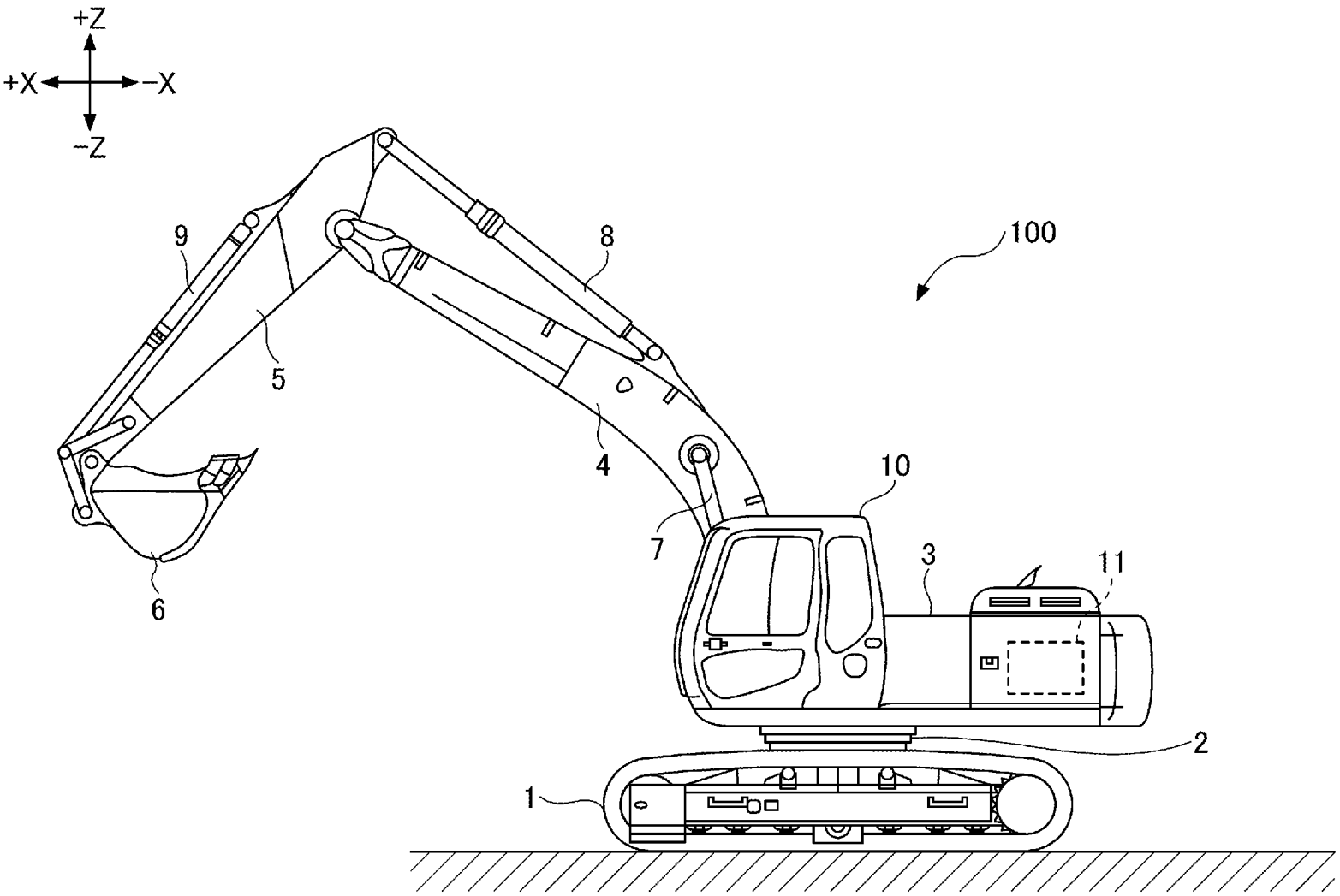
FIG. 1 is a side view of a shovel according to an embodiment of the present invention.

First, an excavator (a shovel 100) as a construction machine according to an embodiment of the present invention is described with reference to FIG. 1. FIG. 1 is a side view of the shovel 100. On a lower traveling structure 1 of the shovel 100 illustrated in FIG. 1, an upper swing structure 3 is swingably mounted via a swing mechanism 2. A boom 4 serving as a work element is attached to the upper swing structure 3. An arm 5 serving as a work element is attached to the distal end of the boom 4. A bucket 6 serving as a work element and an end attachment is attached to the distal end of the arm 5. The boom 4, the arm 5, and the bucket 6 constitute an excavation attachment that is an example of an attachment. The boom 4 is driven by a boom cylinder 7. The arm 5 is driven by an arm cylinder 8. The bucket 6 is driven by a bucket cylinder 9. A cabin 10 is provided and a power source such as an engine 11 is mounted on the upper swing structure 3.

Figure 2:
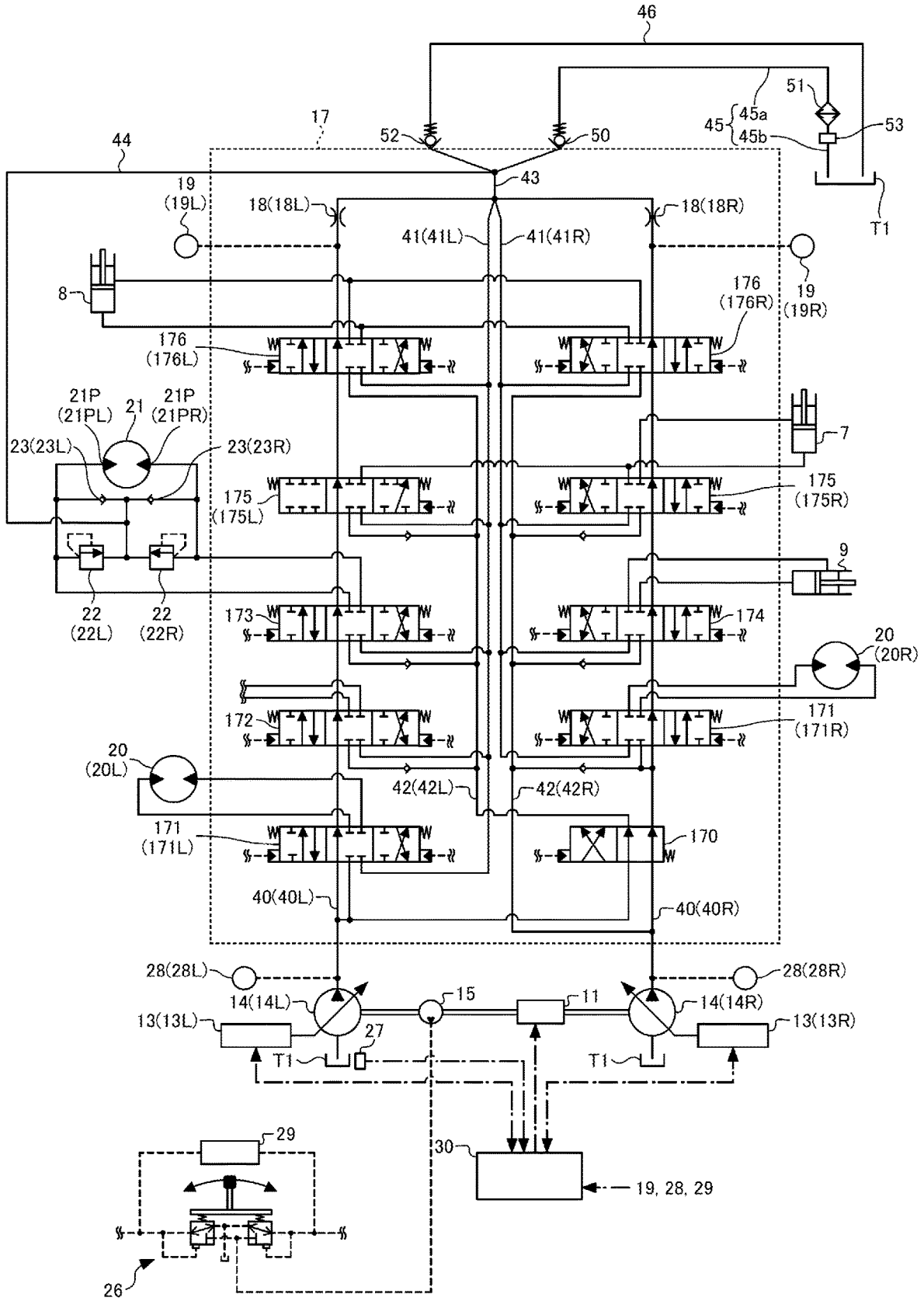
FIG. 2 is a schematic diagram illustrating an example configuration of a drive system installed in the shovel of FIG. 1.

FIG. 2 is a diagram illustrating an example configuration of a drive system installed in the shovel 100 of FIG. 1. In FIG. 2, a mechanical power transmission line is indicated by a double line, a hydraulic oil line is indicated by a solid line, a pilot line is indicated by a dashed line, and an electrical control line is indicated by a one-dot chain line.

The drive system of the shovel 100 mainly includes the engine 11, a pump regulator 13, a main pump 14, a pilot pump 15, an operating device 26, a discharge pressure sensor 28, an operating pressure sensor 29, and a controller 30.

The engine 11 is a power source of the shovel 100. According to this embodiment, the engine 11 is a diesel engine that operates in such a manner as to maintain a predetermined rotational speed. The output shaft of the engine 11 is connected to the respective input shafts of the main pump 14 and the pilot pump 15.

The main pump 14 is configured to be able to supply hydraulic oil to a control valve unit 17. According to this embodiment, the main pump 14 is a swash plate variable displacement hydraulic pump, and includes a left main pump 14L and a right main pump 14R.

The pump regulator 13 is configured to control the discharge amount of the main pump 14. According to this embodiment, the pump regulator 13 controls the discharge amount of the main pump 14 by adjusting the swash plate tilt angle of the main pump 14 in response to a command from the controller 30. The pump regulator 13 may output information on the swash plate tilt angle to the controller 30. Specifically, the pump regulator 13 includes a left pump regulator 13L that controls the discharge amount of the left main pump 14L and a right pump regulator 13R that controls the discharge amount of the right main pump 14R.

The pilot pump 15 is configured to supply hydraulic oil to various hydraulic devices including the operating device 26. According to this embodiment, the pilot pump 15 is a fixed displacement hydraulic pump. The pilot pump 15, however, may be omitted. In this case, the function carried by the pilot pump 15 may be implemented by the main pump 14. That is, the main pump 14 may have the function of supplying hydraulic oil to the operating device 26, etc., after reducing the pressure of the hydraulic oil with a throttle or the like, apart from the function of supplying hydraulic oil to the control valve unit 17.

The control valve unit 17 is configured to accommodate multiple control valves such that the control valves are operable. According to this embodiment, the control valve unit 17 includes multiple control valves that control the flow of hydraulic oil discharged by the main pump 14. The control valve unit 17 is configured to be able to selectively supply hydraulic oil discharged by the main pump 14 to one or more hydraulic actuators through the control valves. The control valves control the flow rate of hydraulic oil flowing from the main pump 14 to the hydraulic actuators and the flow rate of hydraulic oil flowing from the hydraulic actuators to a hydraulic oil tank T1. The hydraulic actuators include the boom cylinder 7, the arm cylinder 8, the bucket cylinder 9, travel hydraulic motors 20, and a swing hydraulic motor 21. The travel hydraulic motors 20 include a left travel hydraulic motor 20L and a right travel hydraulic motor 20R.

The swing hydraulic motor 21 is a hydraulic motor that swings the upper swing structure 3. Oil passages 21P connected to the ports of the swing hydraulic motor 21 are connected to an oil passage 44 via relief valves 22 and check valves 23. Specifically, the oil passages 21P include a left oil passage 21PL and a right oil passage 21PR. The relief valves 22 include a left relief valve 22L and a right relief valve 22R. The check valves 23 include a left check valve 23L and a right check valve 23R.

The left relief valve 22L opens to discharge hydraulic oil in the left oil passage 21PL to the oil passage 44 when the pressure of hydraulic oil in the left oil passage 21PL reaches a predetermined relief pressure. Furthermore, the right relief valve 22R opens to discharge hydraulic oil of hydraulic oil in the right oil passage 21PR to the oil passage 44 when the pressure of hydraulic oil in the right oil passage 21PR reaches a predetermined relief pressure.

The left check valve 23L opens to supply hydraulic oil from the oil passage 44 to the left oil passage 21PL when the pressure of hydraulic oil in the left oil passage 21PL becomes lower than the pressure of hydraulic oil in the oil passage 44. The right check valve 23R opens to supply hydraulic oil from the oil passage 44 to the right oil passage 21PR when the pressure of hydraulic oil in the right oil passage 21PR becomes lower than the pressure of hydraulic oil in the oil passage 44. This configuration enables the check valves 23 to supply hydraulic oil to the intake side port at the time of braking the swing hydraulic motor 21.

The operating device 26 is a device that an operator uses to operate the hydraulic actuators. According to this embodiment, the operating device 26 is a hydraulic type, and supplies hydraulic oil discharged by the pilot pump 15 to a pilot port of a control valve corresponding to each hydraulic actuator via a pilot line. A pilot pressure, which is the pressure of hydraulic oil supplied to each pilot port, is a pressure commensurate with the direction of operation and the amount of operation of a lever or a pedal of the operating device 26 corresponding to each hydraulic actuator. The operating device 26 may also be an electric type.

Specifically, the operating device 26 includes a left operating lever, a right operating lever, a left travel operating lever, a right travel lever, a left travel operating pedal, and a right travel operating pedal. The left operating lever operates as an arm operating lever and a swing operating lever. The right operating lever operates as a boom operating lever and a bucket operating lever.

A temperature sensor 27 is configured to detect the temperature of hydraulic oil in the hydraulic oil tank T1 and output a detected value to the controller 30.

The discharge pressure sensor 28 is configured to detect the discharge pressure of the main pump 14 and output a detected value to the controller 30. According to this embodiment, the discharge pressure sensor 28 includes a left discharge pressure sensor 28L that detects the discharge pressure of the left main pump 14L and a right discharge pressure sensor 28R that detects the discharge pressure of the right main pump 14R.

The operating pressure sensor 29 is a device for detecting the details of the operator's operation using the operating device 26. Examples of operation details include the direction of operation and the amount of operation (the angle of operation). According to this embodiment, the operating pressure sensor 29 is a pressure sensor that detects the direction of operation and the amount of operation of a lever or a pedal of the operating device 26 corresponding to each hydraulic actuator in the form of pressure, and outputs a detected value to the controller 30. The operation details of the operating device 26, however, may also be detected using the output of a device other than a pressure sensor, such as an operating angle sensor, an acceleration sensor, an angular velocity sensor, a resolver, a voltmeter, or an ammeter.

The controller 30 is a control device for controlling the shovel 100. According to this embodiment, the controller 30 is constituted of a computer including a CPU, a volatile storage, and a nonvolatile storage.

A center bypass oil passage 40 is a hydraulic line passing through the control valves placed in the control valve unit 17, and includes a left center bypass oil passage 40L and a right center bypass oil passage 40R.

A control valve 170 is a spool valve serving as a straight traveling valve. The control valve 170 switches the flow of hydraulic oil so that the hydraulic oil is supplied from the main pump 14 to each of the left travel hydraulic motor 20L and the right travel hydraulic motor 20R in order to increase the straightness of traveling of the lower traveling structure 1. Specifically, when the travel hydraulic motors 20 and any other hydraulic actuator are simultaneously operated, the control valve 170 is switched so that the left main pump 14L can supply hydraulic oil to each of the left travel hydraulic motor 20L and the right travel hydraulic motor 20R. When no other hydraulic actuators are operated, the control valve 170 is switched so that the left main pump 14L can supply hydraulic oil to the left travel hydraulic motor 20L and the right main pump 14R can supply hydraulic oil to the right travel hydraulic motor 20R.

Control valves 171 are spool valves that switch the flow of hydraulic oil to supply hydraulic oil discharged by the main pump 14 to the travel hydraulic motors 20 and discharge hydraulic oil discharged by the travel hydraulic motors 20 to the hydraulic oil tank T1. Specifically, the control valves 171 include a control valve 171L and a control valve 171R. The control valve 171L switches the flow of hydraulic oil to supply hydraulic oil discharged by the left main pump 14L to the left travel hydraulic motor 20L and discharge hydraulic oil discharged by the left travel hydraulic motor 20L to the hydraulic oil tank T1. The control valve 171R switches the flow of hydraulic oil to supply hydraulic oil discharged by the left main pump 14L or the right main pump 14R to the right travel hydraulic motor 20R and discharge hydraulic oil discharged by the right travel hydraulic motor 20R to the hydraulic oil tank T1.

A control valve 172 is a spool valve that switches the flow of hydraulic oil to supply hydraulic oil discharged by the left main pump 14L to an optional hydraulic actuator and discharge hydraulic oil discharged by the optional hydraulic actuator to the hydraulic oil tank T1. The optional hydraulic actuator is, for example, a grapple opening and closing cylinder.

A control valve 173 is a spool valve that switches the flow of hydraulic oil to supply hydraulic oil discharged by the left main pump 14L to the swing hydraulic motor 21 and discharge hydraulic oil discharged by the swing hydraulic motor 21 to the hydraulic oil tank T1.

A control valve 174 is a spool valve that switches the flow of hydraulic oil to supply hydraulic oil discharged by the right main pump 14R to the bucket cylinder 9 and discharge hydraulic oil in the bucket cylinder 9 to the hydraulic oil tank T1.

Control valves 175 are spool valves that switch the flow of hydraulic oil to supply hydraulic oil discharged by the main pump 14 to the boom cylinder 7 and discharge hydraulic oil in the boom cylinder 7 to the hydraulic oil tank T1. Specifically, the control valves 175 include a control valve 175L and a control valve 175R. The control valve 175L operates only when an operation to raise the boom 4 is performed, and does not operate when an operation to lower the boom 4 is performed.

Control valves 176 are spool valves that switch the flow of hydraulic oil to supply hydraulic oil discharged by the main pump 14 to the arm cylinder 8 and discharge hydraulic oil in the arm cylinder 8 to the hydraulic oil tank T1. Specifically, the control valves 176 include a control valve 176L and a control valve 176R.

The control valves 170 through 176, which are pilot spool valves according to this embodiment, may also be solenoid spool valves when the operating device 26 is an electric type.

When an operating lever serving as the operating device 26 is an electric type, the amount of lever operation is input to the controller 30 as an electrical signal. Furthermore, a solenoid valve is placed between the pilot pump 15 and a pilot port of each control valve. The solenoid valve is configured to operate in response to an electrical signal from the controller 30. According to this configuration, when a manual operation using the operating lever is performed, the controller 30 can move each control valve by increasing or decreasing a pilot pressure by controlling the solenoid valve with an electrical signal commensurate with the amount of lever operation. Each control valve may be constituted of a solenoid spool valve as described above. In this case, the solenoid spool valve operates in response to an electrical signal from the controller 30 commensurate with the amount of lever operation of the electric operating lever.

A return oil passage 41 is a hydraulic oil line placed in the control valve unit 17, and includes a left return oil passage 41L and a right return oil passage 41R. Hydraulic oil that has flown out from the hydraulic actuators and passed through the control valves 171 through 176 flows toward the hydraulic oil tank T1 through the return oil passage 41.

A parallel oil passage 42 is a hydraulic oil line that runs parallel to the center bypass oil passage 40. According to this embodiment, the parallel oil passage 42 includes a left parallel oil passage 42L that runs parallel to the left center bypass oil passage 40L and a right parallel oil passage 42R that runs parallel to the right center bypass oil passage 40R. When the flow of hydraulic oil through the left center bypass oil passage 40L is restricted or blocked by the control valve 171L, 172, 173 or 175L, the left parallel oil passage 42L can supply hydraulic oil to a control valve further downstream. When the flow of hydraulic oil through the right center bypass oil passage 40R is restricted or blocked by the control valve 171R, 174 or 175R, the right parallel oil passage 42R can supply hydraulic oil to a control valve further downstream.

Here, negative control adopted in the hydraulic system of FIG. 2 is described. A throttle 18 is placed between each of the most downstream control valves 175 and the hydraulic oil tank T1 in the center bypass oil passage 40. The flow of hydraulic oil discharged by the main pump 14 is restricted by the throttle 18. The throttle 18 generates a control pressure for controlling the pump regulator 13. Specifically, the throttle 18 is a fixed throttle whose opening area is fixed, and includes a left throttle 18L and a right throttle 18R. The throttle 18 tends to increase stability against a sudden change in the control pressure as the opening area increases. Furthermore, the throttle 18 tends to increase the responsiveness of the control pressure as the opening area decreases. The flow of hydraulic oil discharged by the left main pump 14L is restricted by the left throttle 18L, and the left throttle 18L generates a control pressure for controlling the left pump regulator 13L. Likewise, the flow of hydraulic oil discharged by the right main pump 14R is restricted by the right throttle 18R, and the right throttle 18R generates a control pressure for controlling the right pump regulator 13R.

A control pressure sensor 19 is a sensor that detects the control pressure generated upstream of the throttle 18, and includes a left control pressure sensor 19L and a right control pressure sensor 19R. According to this embodiment, the control pressure sensor 19 is configured to output a detected value to the controller 30. The controller 30 outputs a command corresponding to the control pressure to the pump regulator 13. The pump regulator 13 controls the discharge quantity of the main pump 14 by adjusting the swash plate tilt angle of the main pump 14 according to the command. Specifically, the pump regulator 13 decreases the discharge quantity of the main pump 14 as the control pressure increases, and increases the discharge quantity of the main pump 14 as the control pressure decreases.

Because of the negative control, the hydraulic system of FIG. 2 can control unnecessary energy consumption in the main pump 14 when none of the hydraulic actuators is operated. The unnecessary energy consumption includes pumping loss that hydraulic oil discharged by the main pump 14 causes in the center bypass oil passage 40. It is ensured that when a hydraulic actuator is operated, necessary and sufficient hydraulic oil is supplied from the main pump 14 to the operated hydraulic actuator.

The center bypass oil passage 40 and the return oil passage 41 are connected to a junction with an oil passage 43 downstream of the throttle 18. The oil passage 43 bifurcates downstream of the junction to be connected to an oil passage 45 and an oil passage 46 outside the control valve unit 17. That is, hydraulic oil flowing through the center bypass oil passage 40 and hydraulic oil flowing through the return oil passage 41 merge in the oil passage 43 and thereafter arrive at the hydraulic oil tank T1 through the oil passage 45 and the oil passage 46. Furthermore, the oil passage 43 is connected to the swing hydraulic motor 21 via the oil passage 44 that is a hydraulic oil line for compensating for a shortage of hydraulic oil on the intake side of the swing hydraulic motor 21.

The oil passage 45 is a hydraulic oil line that connects the oil passage 43 and the hydraulic oil tank T1. A check valve 50, an oil cooler 51, and a filter 53 are placed in the oil passage 45.

The check valve 50 is a valve that opens when the pressure difference between the primary side and the secondary side exceeds a predetermined valve opening pressure difference. According to this embodiment, the check valve 50 is a spring check valve, and opens to cause hydraulic oil in the control valve unit 17 to flow out toward the oil cooler 51 when the upstream pressure is higher than the downstream pressure and the pressure difference exceeds the valve opening pressure difference. This configuration enables the check valve 50 to maintain the pressure of hydraulic oil in the oil passage 43 and the oil passage 44 at a level higher than a valve opening pressure and ensure that the shortage of hydraulic oil on the intake side of the swing hydraulic motor 21 is compensated for. In this case, the valve opening pressure is the lower limit value of a back pressure against the throttle 18. The back pressure against the throttle 18 increases as the flow rate of hydraulic oil passing through the check valve 50 increases. The check valve 50 may be integrated into the control valve unit 17 or may be omitted. In the case where the check valve 50 is omitted, a pressure loss in each of the oil passage 45, the oil cooler 51, and the filter 53 becomes a back pressure against the throttle 18. The back pressure against the throttle 18 increases as the flow rate of hydraulic oil passing through the oil passage 45 increases.

The oil cooler 51 is a device for cooling hydraulic oil that circulates in the hydraulic system. According to this embodiment, the oil cooler 51 is included in a heat exchanger unit cooled by a cooling fan driven by the engine 11. The heat exchanger unit includes a radiator, an intercooler, and the oil cooler 51. Furthermore, according to this embodiment, the oil passage 45 includes an oil passage section 45*a* that connects the check valve 50 and the oil cooler 51 and an oil passage section 45*b* that connects the oil cooler 51 and the hydraulic oil tank T1. The filter 53 is placed in the oil passage section 45*b*.

The oil passage 46 is a bypass oil passage that bypasses the oil cooler 51. According to this embodiment, the oil passage 46 has one end connected to the oil passage 43 and the other end connected to the hydraulic oil tank T1. The one end may be connected to the oil passage 45 between the check valve 50 and the oil cooler 51. Furthermore, a check valve 52 is placed in the oil passage 46.

Like the check valve 50, the check valve 52 is a valve that opens when the pressure difference between the primary side and the secondary side exceeds a predetermined valve opening pressure difference. According to this embodiment, the check valve 52 is a spring check valve, and opens to cause hydraulic oil in the control valve unit 17 to flow out toward the hydraulic oil tank T1 when the upstream pressure is higher than the downstream pressure and the pressure difference exceeds the valve opening pressure difference. The valve opening pressure difference for the check valve 52 is greater than the valve opening pressure difference for the check valve 50. Therefore, hydraulic oil in the control valve unit 17 first flows through the check valve 50, and thereafter, when the pressure exceeds the valve opening pressure because of resistance during passage through the oil cooler 51, flows through the check valve 52. The check valve 52 may be integrated into the control valve unit 17.

Figure 3:
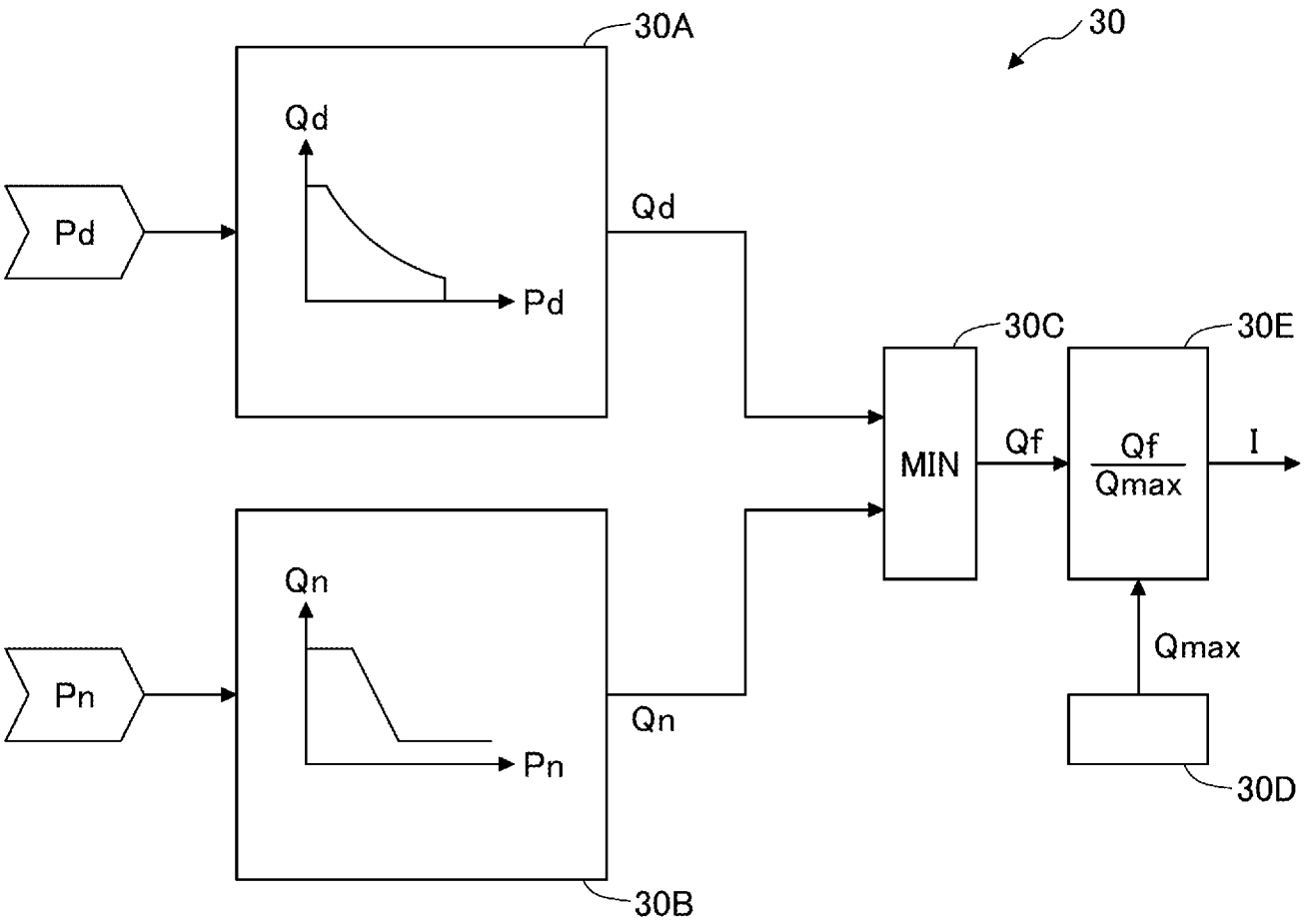
FIG. 3 is a diagram illustrating an example configuration of a discharge quantity control function.

Next, an example of the function of the controller 30 to control the discharge quantity of the main pump 14 (hereinafter "discharge quantity control function") is described with reference to FIG. 3. FIG. 3 illustrates an example configuration of the controller 30 that implements the discharge quantity control function. According to this embodiment, the controller 30 includes a power control part 30A, an energy saving control part 30B, a minimum value selecting part 30C, a maximum value setting part 30D, and a current command output part 30E.

The power control part 30A is a control part that implements power control that is one of functions to control the discharge quantity of the main pump 14, and is configured to derive a command value Qd of a discharge quantity Q based on a discharge pressure Pd of the main pump 14. The power control is a function to adjust the discharge quantity of the main pump 14 such that absorbed power expressed by the product of the discharge quantity and the discharge pressure of the main pump 14 is less than or equal to the output power of the engine 11. According to this embodiment, the power control part 30A obtains the discharge pressure Pd output by the discharge pressure sensor 28. Then, the power control part 30A refers to a reference table to derive the command value Qd corresponding to the obtained discharge pressure Pd. The reference table, which is a reference table about a PQ diagram that retains the correspondence between the maximum absorbable power (for example, maximum allowable horsepower), the discharge pressure Pd, and the command value Qd of the main pump 14 such that the correspondence can be referred to, is prestored in the nonvolatile storage. The power control part 30A can uniquely determine the command value Qd by referring to the reference table using the preset maximum absorbable horsepower of the main pump 14 and the discharge pressure Pd output by the discharge pressure sensor 28 as a retrieval key, for example.

The energy saving control part 30B is a control part that implements negative control that is one of functions to control the discharge quantity of the main pump 14, and is configured to derive a command value Qn of the discharge quantity Q based on a control pressure Pn. According to this embodiment, the energy saving control part 30B obtains the control pressure Pn output by the control pressure sensor 19. Then, the energy saving control part 30B refers to a reference table to derive the command value Qn corresponding to the obtained control pressure Pn. The reference table, which is a reference table that retains the correspondence between the control pressure Pn and the command value Qn such that the correspondence can be referred to, is prestored in the nonvolatile storage.

The minimum value selecting part 30C is configured to select and output a minimum value from input values. According to this embodiment, the minimum value selecting part 30C is configured to output the smaller of the command value Qd and the command value Qn as a final command value Qf.

The command value Qn derived by the energy saving control part 30B is typically selected by the minimum value selecting part 30C when work with a relatively low load, such as finishing work or leveling work, is performed. In contrast, the command value Qd derived by the power control part 30A is typically selected by the minimum value selecting part 30C when work with a relatively high load, such as excavation work, is performed.

The maximum value setting part 30D is configured to output a maximum command value Qmax. The maximum command value Qmax is a command value corresponding to the maximum discharge quantity of the main pump 14. According to this embodiment, the maximum value setting part 30D is configured to output the maximum command value Qmax prestored in the nonvolatile storage or the like to the current command output part 30E.

The current command output part 30E is configured to output a current command to the pump regulator 13. According to this embodiment, the current command output part 30E outputs a current command I derived based on the final command value Qf output by the minimum value selecting part 30C and the maximum command value Qmax output by the maximum value setting part 30D to the pump regulator 13. The current command output part 30E may output the current command I derived based on the final command value Qf to the pump regulator 13.

Figure 4:
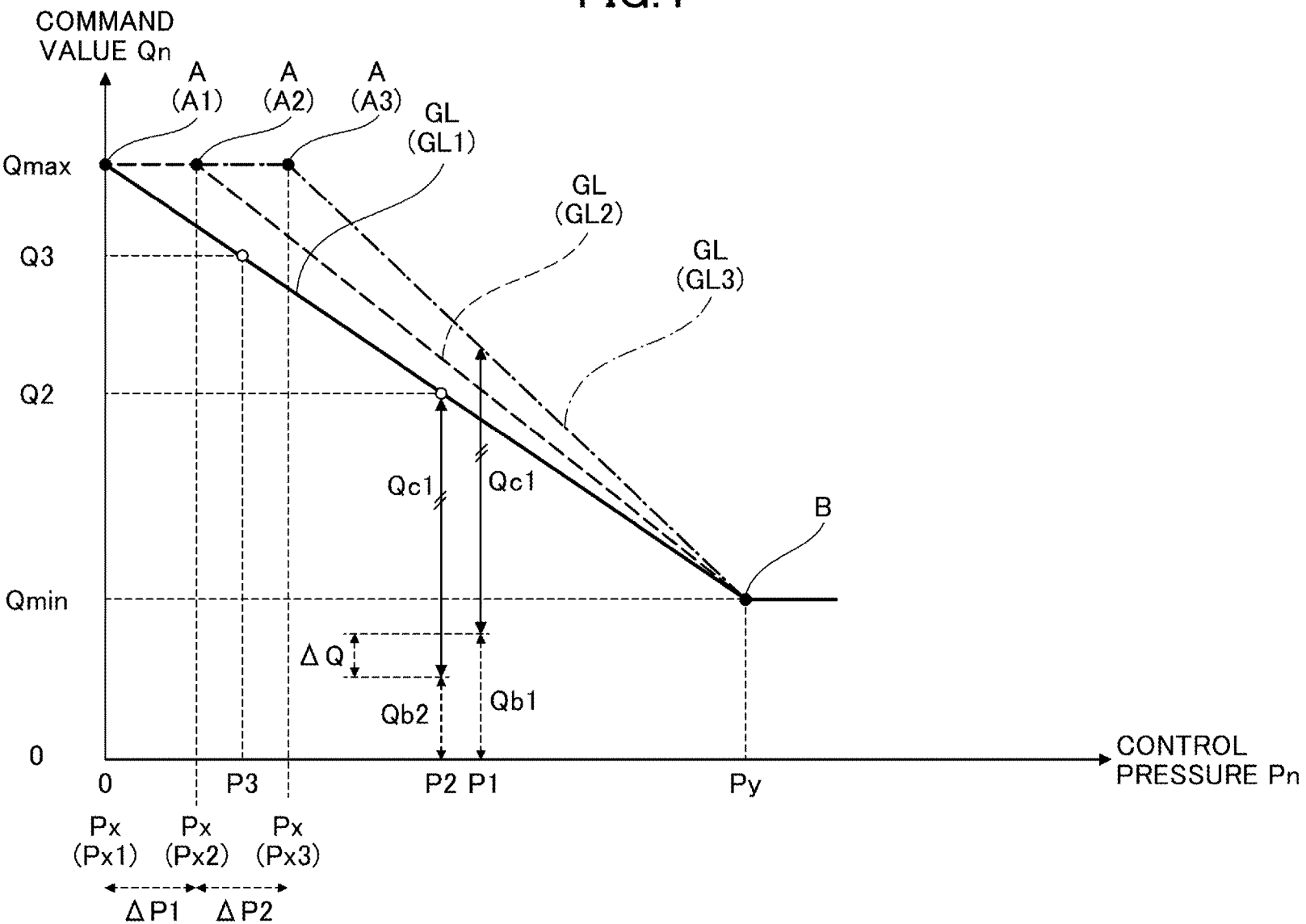
FIG. 4 is a diagram illustrating an example of the contents of a reference table.

Next, the contents of the reference table referred to by the energy saving control part 30B are described with reference to FIG. 4. FIG. 4 is a diagram illustrating the correspondence between the control pressure Pn and the command value Qn, which is the contents of the reference table. Specifically, in FIG. 4, the control pressure Pn detected by the control pressure sensor 19 is on the horizontal axis, and the command value Qn is on the vertical axis. A polygonal chain (including an inclined line GL) indicates the relationship between the command value Qn and the control pressure Pn. The command value Qn corresponds to the target discharge quantity of the main pump 14. The controller 30 controls the pump regulator 13 such that the actual discharge quantity Q of the main pump 14 becomes the target discharge quantity. The target discharge quantity corresponds to the combined flow rate of a bleed flow rate Qb and a cylinder flow rate Qc. The bleed flow rate Qb is the flow rate of hydraulic oil passing through the throttle 18. The cylinder flow rate Qc is the flow rate of hydraulic oil that flows into a hydraulic cylinder (the bottom-side oil chamber of the arm cylinder 8 in the example of FIG. 4). The bleed flow rate Qb increases as the control pressure increases.

More specifically, FIG. 4 is a diagram illustrating the contents of a reference table that is referred to when the left operating lever is operated in an arm closing direction during leveling work. In FIG. 4, the solid line represents the correspondence between the control pressure Pn and the command value Qn when an inching operation is performed on the left operating lever. For example, letting the amount of operation be 0% when the left operating lever is at a neutral position and 100% when the left operating lever is tilted to a maximum extent, the inching operation means an operation with the amount of lever operation of less than 20%. Furthermore, in FIG. 4, the dashed line represents the correspondence between the control pressure Pn and the command value Qn when a half lever operation is performed on the left operating lever. The half lever operation means an operation with the amount of operation of more than or equal to 20% and less than 80%, for example. Likewise, in FIG. 4, the one-dot chain line represents the correspondence between the control pressure Pn and the command value Qn when a full lever operation is performed on the left operating lever. The full lever operation means an operation with the amount of operation of more than or equal to 80%, for example.

According to this embodiment, the energy saving control part 30B is configured to derive the command value Qn corresponding to the control pressure Pn using the inclined line GL that passes through an upper end point A and a lower end point B.

The upper end point A is a point that defines the upper end of the inclined line GL, and is expressed by the maximum command value Qmax and a first set pressure Px. The maximum command value Qmax is the upper limit of a command value used in the negative control, and is a fixed value corresponding to the maximum swash plate tilt angle of the main pump 14, for example. The first set pressure Px is a variable value that varies according to an arm closing pilot pressure that is a pilot pressure when the left operating lever is operated in the arm closing direction.

The lower end point B is a point that defines the lower end of the inclined line GL, and is expressed by a minimum command value Qmin and a second set pressure Py. The minimum command value Qmin is the lower limit of a command value used in the negative control, and is a fixed value corresponding to a swash plate tilt angle that is a predetermined angle greater than the minimum swash plate tilt angle of the main pump 14 (for example, a swash plate tilt angle corresponding to a standby flow rate), for example. The second set pressure Py is a fixed value set independent of the arm closing pilot pressure, and corresponds to a control pressure when hydraulic oil of the standby flow rate passes through the throttle 18, for example.

According to the example illustrated in FIG. 4, the energy saving control part 30B is configured to be able to adjust the correspondence between the control pressure Pn and the command value Qn by changing the position of the upper end point A in the direction of the horizontal axis, namely, by changing the first set pressure Px.

Specifically, the energy saving control part 30B adjusts the correspondence between the control pressure Pn and the command value Qn to that suitable for the condition of the shovel 100 at the time by causing the position of the upper end point A to differ between when the inching operation is being performed, when the half lever operation is being performed, and when the full lever operation is being performed. The energy saving control part 30B, which causes the position of the upper end point A to differ in the three steps of when the inching operation is being performed, when the half lever operation is being performed, and when the full lever operation is being performed for the convenience of description according to the example illustrated in FIG. 4, is actually configured to change the position of the upper end point A in a stepless manner according to the arm closing pilot pressure at predetermined control intervals.

More specifically, the energy saving control part 30B is configured not to shift the upper end point A from an initial upper end point A1 (a point when the first set pressure Px is at a set value Px1 (zero)) such that the inclined line GL is an inclined line GL1 as indicated by the solid line in FIG. 4, when the inching operation is being performed.

The energy saving control part 30B shifts the upper end point A from the initial upper end point A1 to an upper end point A2 such that the inclined line GL is an inclined line GL2 as indicated by the dashed line in FIG. 4, when the half lever operation is being performed. The upper end point A2 is a point where a corresponding set value Px2 of the control pressure Pn is greater than the set value Px1 (zero) corresponding to the initial upper end point A1 by ΔP1. Furthermore, the energy saving control part 30B shifts the upper end point A to an upper end point A3 such that the inclined line GL is an inclined line GL3 as indicated by the one-dot chain line in FIG. 4, when the full lever operation is being performed. The upper end point A3 is a point where a corresponding set value Px3 of the control pressure Pn is greater than the set value Px2 corresponding to the upper end point A2 by ΔP2.

By thus changing the position of the upper end point A in the direction of the horizontal axis, the energy saving control part 30B can reduce the flow rate of hydraulic oil unnecessarily discharged to the hydraulic oil tank T1 through the throttle 18 when arm closing is performed.

For example, if the inclined line GL is fixed at the inclined line GL3, which is employed in the case of the full lever operation, when the left operating lever is operated in the arm closing direction with the inching operation, the actual control pressure Pn has to be a value P1 in order to ensure a flow rate Qc1 as the cylinder flow rate Qc that is the flow rate of hydraulic oil flowing into the arm cylinder 8. In this case, the bleed flow rate Qb is a flow rate Qb1.

In contrast, when the inclined line GL1 is employed as the inclined line GL, the actual control pressure Pn may be a value P2 smaller than the value P1 in order to ensure the flow rate Qc1 as the cylinder flow rate Qc. In this case, the bleed flow rate Qb is a flow rate Qb2 that is lower than the flow rate Qb1 by AQ. This is because the bleed flow rate Qb decreases as the control pressure Pn decreases. That is, the energy saving control part 30B can reduce the bleed flow rate Qb by ΔQ while maintaining the cylinder flow rate Qc at the flow rate Qc1 and further can reduce the discharge quantity of the main pump 14.

Thus, the controller 30 can more flexibly control the discharge quantity of the main pump 14 by changing the control characteristic of the negative control according to the operation details of the operating device 26. Specifically, the energy saving control part 30B can reduce the bleed flow rate Qb without reducing the cylinder flow rate Qc by adjusting the inclined line GL according to the arm closing pilot pressure. Therefore, the energy saving control part 30B can reduce the amount of hydraulic oil unnecessarily discharged to the hydraulic oil tank T1.

The energy saving control part 30B, for example, derives a value Q2 as the command value Qn when the control pressure Pn is the value P2.

Furthermore, by moving the position of the upper end point A as described above, the energy saving control part 30B can prevent the discharge quantity Q from decreasing because of a high back pressure when arm closing is performed with the full lever operation.

For example, if the inclined line GL is fixed at the inclined line GL1, which is employed in the case of the inching operation, when the left operating lever is operated in the arm closing direction with the full lever operation, the command value Qn is restricted to a value Q3 smaller than the maximum command value Qmax when the back pressure is a value P3 greater than the set value Px1 (zero) of the first set pressure Px at the initial upper end point A1. That is, the main pump 14 is not set at a maximum swash plate tilt angle in spite of being in a situation where the full lever operation is being performed and the discharge quantity Q has to be increased as much as possible. This is because the control pressure Pn cannot be a value smaller than the value P3 of the back pressure that is the pressure of hydraulic oil on the downstream side of the throttle 18. Specifically, this is because the control pressure Pn in this case is determined not by the bleed flow rate Qb that is the flow rate of hydraulic oil passing through the throttle 18 but by the back pressure and because the controller 30 cannot derive the command value Qn corresponding to the true control pressure Pn that has to be determined by the bleed flow rate Qb.

In contrast, when the inclined line GL3 is employed as the inclined line GL, the upper end point A3 is set such that the set value Px3 of the first set pressure Px is greater than or equal to the value P3 of the back pressure. In this case, the energy saving control part 30B derives the maximum command value Qmax as the command value Qn when the actual control pressure Pn is the value P3. As a result, the main pump 14 is controlled such that its swash plate tilt angle is maximized, and can discharge hydraulic oil with a maximum discharge quantity.

The above description referring to FIG. 4, which is applied to the case where the left operating lever is singly operated in the arm closing direction, is likewise applied to the case where the left operating lever is singly operated in an arm opening direction, a counterclockwise swing direction, or a clockwise swing direction or the case where the right operating lever is singly operated in a boom raising direction, a boom lowering direction, a bucket closing direction, or a bucket opening direction. The above description is also likewise applied to the case where the travel lever is singly operated in a forward traveling direction or a backward traveling direction. Furthermore, the above description is also likewise applied to the case where a complex operation with one or more devices of the operating device 26 is performed. In this case, the controller 30 may be configured such that the amount of shift of the upper end point A including ΔP1 and ΔP2 differ between when the left operating lever is singly operated and when the right operating lever is singly operated. The controller 30 may also be configured such that the amount of shift of the upper end point A differs between when the left operating lever is singly operated in the arm closing direction and when the left operating lever is singly operated in the arm opening direction. The controller 30 may also be configured such that the amount of shift of the upper end point A differs between when a single operation is performed and when a complex operation is performed.

Figure 5:
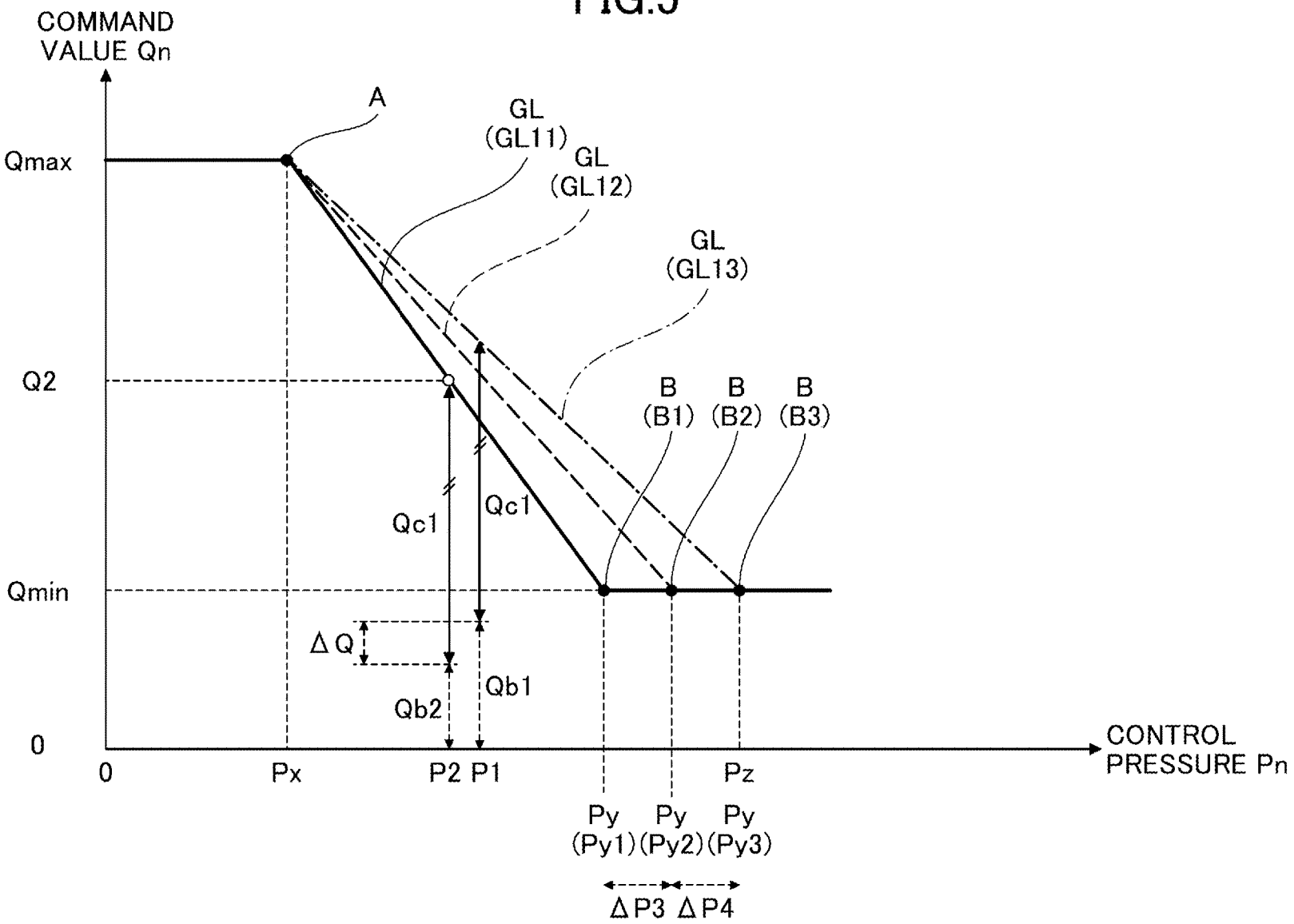
FIG. 5 is a diagram illustrating another example of the contents of the reference table.

Next, another example of the contents of the reference table referred to by the energy saving control part 30B is described with reference to FIG. 5. FIG. 5 is a diagram illustrating the correspondence between the control pressure Pn and the command value Qn, which is the contents of the reference table, and corresponds to FIG. 4.

The correspondence illustrated in FIG. 5 is different from the correspondence illustrated in FIG. 4 in that the upper end point A defining the upper end of the inclined line GL is fixed and the lower end point B defining the lower end of the inclined line GL is variable, but is otherwise equal to the correspondence illustrated in FIG. 4. Therefore, the description of a common portion is omitted and differences are described in detail.

According to the example illustrated in FIG. 5, the energy saving control part 30B is configured to be able to adjust the correspondence between the control pressure Pn and the command value Qn by changing the position of the lower end point B, namely, by changing the second set pressure Py.

Specifically, the energy saving control part 30B adjusts the correspondence between the control pressure Pn and the command value Qn to that suitable for the condition of the shovel 100 at the time by causing the position of the lower end point B to differ between when the inching operation is being performed, when the half lever operation is being performed, and when the full lever operation is being performed. The energy saving control part 30B, which causes the position of the lower end point B to differ in the three steps of when the inching operation is being performed, when the half lever operation is being performed, and when the full lever operation is being performed for the convenience of description according to the example illustrated in FIG. 5, is actually configured to change the position of the lower end point B in a stepless manner according to the arm closing pilot pressure at predetermined control intervals.

More specifically, the energy saving control part 30B is configured not to shift the lower end point B from an initial lower end point B1 such that the inclined line GL is an inclined line GL11 as indicated by the solid line in FIG. 5, when the inching operation is being performed.

In this case, the cylinder flow rate Qc, which is the flow rate of hydraulic oil flowing into the bottom-side oil chamber of the arm cylinder 8, is controlled in such a manner as to slowly increase as the control pressure Pn decreases from a value Pz toward a set value Py1 of the second set pressure Py. This is because the bleed flow rate Qb decreases under circumstances where the discharge quantity Q is maintained at a quantity corresponding to the minimum command value Qmin. Therefore, the operator of the shovel 100 can gradually increase the cylinder flow rate Qc by gradually tilting the left operating lever in the arm closing direction within the range of the control pressure Pn from the value Pz to the set value Py1 of the second set pressure Py. That is, the operator can perform the inching operation of the arm 5 over a relatively wide range of the control pressure Pn (the amount of lever operation). As a result, the shovel 100 can increase the operability of the arm 5 at the start of its movement when the inching operation of the arm 5 is performed.

The energy saving control part 30B shifts the lower end point B from the initial lower end point B1 to a lower end point B2 such that the inclined line GL is an inclined line GL12 as indicated by the dashed line in FIG. 5, when the half lever operation is being performed. The lower end point B2 is a point where a corresponding set value Py2 of the control pressure Pn is greater than the set value Py1 of the control pressure Pn corresponding to the initial lower end point B1 by ΔP3. Furthermore, the energy saving control part 30B shifts the lower end point B to a lower end point B3 such that the inclined line GL is an inclined line GL13 as indicated by the one-dot chain line in FIG. 5, when the full lever operation is being performed. The lower end point B3 is a point where a corresponding set value Py3 of the control pressure Pn is greater than the set value Py2 of the control pressure Pn corresponding to the lower end point B2 by ΔP4.

By thus changing the position of the lower end point B, the energy saving control part 30B can reduce the flow rate of hydraulic oil unnecessarily discharged to the hydraulic oil tank T1 through the throttle 18 when arm closing is performed.

For example, if the inclined line GL is fixed at the inclined line GL13, which is employed in the case of the full lever operation, when the left operating lever is operated in the arm closing direction with the inching operation, the actual control pressure Pn has to be the value P1 in order to ensure the flow rate Qc1 as the cylinder flow rate Qc that is the flow rate of hydraulic oil flowing into the arm cylinder 8. In this case, the bleed flow rate Qb is the flow rate Qb1.

In contrast, when the inclined line GL11 is employed as the inclined line GL, the actual control pressure Pn may be the value P2 smaller than the value P1 in order to ensure the flow rate Qc1 as the cylinder flow rate Qc. In this case, the bleed flow rate Qb is the flow rate Qb2 that is lower than the flow rate Qb1 by ΔQ. This is because the bleed flow rate Qb decreases as the control pressure Pn decreases. That is, the energy saving control part 30B can reduce the bleed flow rate Qb by ΔQ while maintaining the cylinder flow rate Qc at the flow rate Qc1 and further can reduce the discharge quantity of the main pump 14.

The energy saving control part 30B, for example, derives the value Q2 as the command value Qn when the control pressure Pn is the value P2.

By thus adjusting the inclined line GL according to the arm closing pilot pressure, the energy saving control part 30B can reduce the bleed flow rate Qb without reducing the cylinder flow rate Qc. Therefore, the energy saving control part 30B can reduce the amount of hydraulic oil unnecessarily discharged to the hydraulic oil tank T1.

Furthermore, by moving the position of the lower end point B as described above as well, the energy saving control part 30B can prevent the discharge quantity Q from decreasing because of a high back pressure when arm closing is performed with the full lever operation, the same as in the case of moving the position of the upper end point A.

The above description referring to FIG. 5, which is applied to the case where the left operating lever is singly operated in the arm closing direction, is likewise applied to the case where the left operating lever is singly operated in the arm opening direction, the counterclockwise swing direction, or the clockwise swing direction or the case where the right operating lever is singly operated in the boom raising direction, the boom lowering direction, the bucket closing direction, or the bucket opening direction. The above description is also likewise applied to the case where the travel lever is singly operated in the forward traveling direction or the backward traveling direction. Furthermore, the above description is also likewise applied to the case where a complex operation with one or more devices of the operating device 26 is performed. In this case, the controller 30 may be configured such that the amount of shift of the lower end point B including ΔP3 and ΔP4 differ between when the left operating lever is singly operated and when the right operating lever is singly operated. The controller 30 may also be configured such that the amount of shift of the lower end point B differs between when the left operating lever is singly operated in the arm closing direction and when the left operating lever is singly operated in the arm opening direction. The controller 30 may also be configured such that the amount of shift of the lower end point B differs between when a single operation is performed and when a complex operation is performed.

Furthermore, the controller 30 may also be configured to prevent the position of the lower end point B from changing, that is, to fix the lower end point B at the position at that time when the left operating lever tilted in the arm closing direction is returned to the neutral position, namely, when the amount of lever operation of the left operating lever decreases. This is for preventing a sudden decrease in the discharge quantity of the main pump 14, that is, for preventing a sudden decrease in the closing speed of the arm 5. In this case, the controller 30 may be configured to return the position of the lower end point B to the position of the initial lower end point B1 when the left operating lever has returned to the neutral position, that is, when the amount of lever operation of the left operating lever has become zero.

Figure 6:
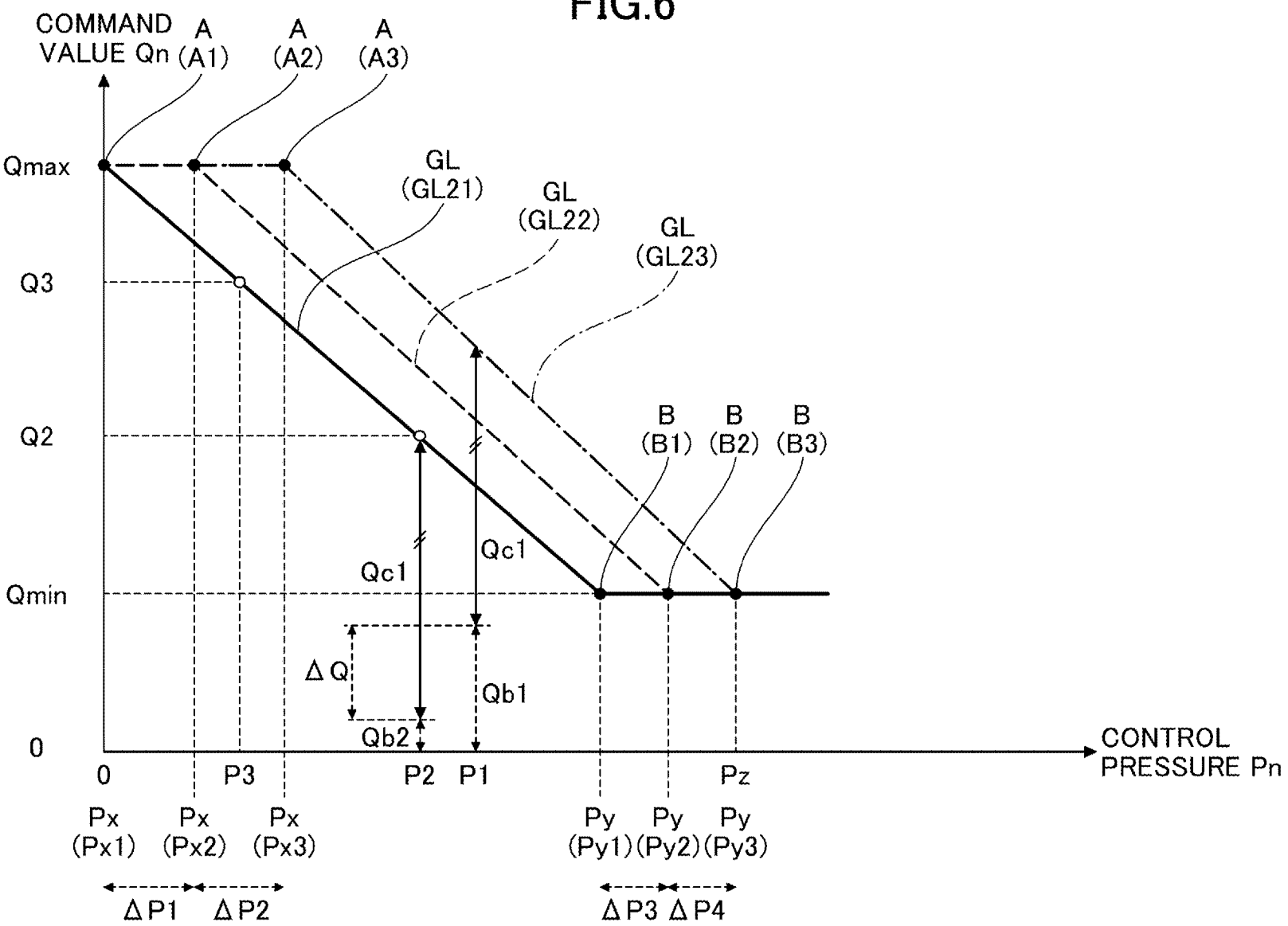
FIG. 6 is a diagram illustrating yet another example of the contents of the reference table.

Next, yet another example of the contents of the reference table referred to by the energy saving control part 30B is described with reference to FIG. 6. FIG. 6 is a diagram illustrating the correspondence between the control pressure Pn and the command value Qn, which is the contents of the reference table, and corresponds to each of FIGS. 4 and 5.

The correspondence illustrated in FIG. 6 is different from the correspondence illustrated in each of FIGS. 4 and 5 in that the positions of both of the upper end point A defining the upper end of the inclined line GL and the lower end point B defining the lower end of the inclined line GL are variable, but is otherwise equal to the correspondence illustrated in each of FIGS. 4 and 5. Therefore, the description of a common portion is omitted and differences are described in detail.

According to the example illustrated in FIG. 6, the energy saving control part 30B is configured to be able to adjust the correspondence between the control pressure Pn and the command value Qn by changing each of the position of the upper end point A and the lower end point B, namely, by changing each of the first set pressure Px and the second set pressure Py.

Specifically, the energy saving control part 30B adjusts the correspondence between the control pressure Pn and the command value Qn to that suitable for the condition of the shovel 100 at the time by causing the position of each of the upper end point A and the lower end point B to differ between when the inching operation is being performed, when the half lever operation is being performed, and when the full lever operation is being performed. The energy saving control part 30B, which causes the position of each of the upper end point A and the lower end point B to differ in the three steps of when the inching operation is being performed, when the half lever operation is being performed, and when the full lever operation is being performed for the convenience of description according to the example illustrated in FIG. 6, is actually configured to change the position of each of the upper end point A and the lower end point B in a stepless manner according to the arm closing pilot pressure at predetermined control intervals.

More specifically, the energy saving control part 30B is configured not to shift the upper end point A from the initial upper end point A1 and not to shift the lower end point B from the initial lower end point B1 such that the inclined line GL is an inclined line GL21 as indicated by the solid line in FIG. 6, when the inching operation is being performed.

In this case, the cylinder flow rate Qc, which is the flow rate of hydraulic oil flowing into the bottom-side oil chamber of the arm cylinder 8, is controlled in such a manner as to slowly increase as the control pressure Pn decreases from the value Pz toward the set value Py1 of the second set pressure Py. This is because the bleed flow rate Qb decreases under circumstances where the discharge quantity Q is maintained at a quantity corresponding to the minimum command value Qmin. Therefore, the operator of the shovel 100 can gradually increase the cylinder flow rate Qc by gradually tilting the left operating lever in the arm closing direction within the range of the control pressure Pn from the value Pz to the set value Py1 of the second set pressure Py. That is, the operator can perform the inching operation of the arm 5 over a relatively wide range of the control pressure Pn (the amount of lever operation). As a result, the shovel 100 can increase the operability of the arm 5 at the start of its movement when the inching operation of the arm 5 is performed.

The energy saving control part 30B shifts the upper end point A from the initial upper end point A1 to the upper end point A2 and shifts the lower end point B from the initial lower end point B1 to the lower end point B2 such that the inclined line GL is an inclined line GL22 as indicated by the dashed line in FIG. 6, when the half lever operation is being performed. The upper end point A2 is a point where the corresponding set value Px2 of the control pressure Pn is greater than the set value Px1 of the control pressure Pn corresponding to the initial upper end point A1 by ΔP1. The lower end point B2 is a point where the corresponding set value Py2 of the control pressure Pn is greater than the set value Py1 of the control pressure Pn corresponding to the initial lower end point B1 by ΔP3. Furthermore, the energy saving control part 30B shifts the upper end point A to the upper end point A3 and shifts the lower end point B to the lower end point B3 such that the inclined line GL is an inclined line GL23 as indicated by the one-dot chain line in FIG. 6, when the full lever operation is being performed. The upper end point A3 is a point where the corresponding set value Px3 of the control pressure Pn is greater than the set value Px2 of the control pressure Pn corresponding to the upper end point A2 by ΔP2. The lower end point B3 is a point where the corresponding set value Py3 of the control pressure Pn is greater than the set value Py2 of the control pressure Pn corresponding to the lower end point B2 by ΔP4.

By thus changing the position of each of the upper end point A and the lower end point B, the energy saving control part 30B can reduce the flow rate of hydraulic oil unnecessarily discharged to the hydraulic oil tank T1 through the throttle 18 when arm closing is performed.

For example, if the inclined line GL is fixed at the inclined line GL23, which is employed in the case of the full lever operation, when the left operating lever is operated in the arm closing direction with the inching operation, the actual control pressure Pn has to be the value P1 in order to ensure the flow rate Qc1 as the cylinder flow rate Qc that is the flow rate of hydraulic oil flowing into the arm cylinder 8. In this case, the bleed flow rate Qb is the flow rate Qb1.

In contrast, when the inclined line GL21 is employed as the inclined line GL, the actual control pressure Pn may be the value P2 smaller than the value P1 in order to ensure the flow rate Qc1 as the cylinder flow rate Qc. In this case, the bleed flow rate Qb is the flow rate Qb2 that is lower than the flow rate Qb1 by ΔQ. This is because the bleed flow rate Qb decreases as the control pressure Pn decreases. That is, the energy saving control part 30B can reduce the bleed flow rate Qb by ΔQ while maintaining the cylinder flow rate Qc at the flow rate Qc1 and further can reduce the discharge quantity of the main pump 14.

The energy saving control part 30B, for example, derives the value Q2 as the command value Qn when the control pressure Pn is the value P2.

By thus adjusting the inclined line GL according to the arm closing pilot pressure, the energy saving control part 30B can reduce the bleed flow rate Qb without reducing the cylinder flow rate Qc. Therefore, the energy saving control part 30B can reduce the amount of hydraulic oil unnecessarily discharged to the hydraulic oil tank T1.

Furthermore, by moving the position of each of the upper end point A and the lower end point B as described above as well, the energy saving control part 30B can prevent the discharge quantity Q from decreasing because of a high back pressure when arm closing is performed with the full lever operation, the same as in the case of moving the position of only the upper end point A or in the case of moving the position of only the lower end point B.

For example, if the inclined line GL is fixed at the inclined line GL21, which is employed in the case of the inching operation, when the left operating lever is operated in the arm closing direction with the full lever operation, the command value Qn is restricted to the value Q3 smaller than the maximum command value Qmax when the back pressure is the value P3 greater than the set value Px1 (zero) of the first set pressure Px at the initial upper end point A1. That is, the main pump 14 is not set at a maximum swash plate tilt angle in spite of being in a situation where the full lever operation is being performed and the discharge quantity Q has to be increased as much as possible. This is because the control pressure Pn cannot be a value smaller than the value P3 of the back pressure. Specifically, this is because the control pressure Pn in this case is determined not by the bleed flow rate Qb that is the flow rate of hydraulic oil passing through the throttle 18 but by the back pressure and because the controller 30 cannot derive the command value Qn corresponding to the true control pressure Pn that has to be determined by the bleed flow rate Qb.

In contrast, when the inclined line GL23 is employed as the inclined line GL, the upper end point A3 is set such that the set value Px3 of the first set pressure Px is greater than or equal to the value P3 of the back pressure. In this case, the energy saving control part 30B derives the maximum command value Qmax as the command value Qn when the actual control pressure Pn is the value P3. As a result, the main pump 14 is controlled such that its swash plate tilt angle is maximized, and can discharge hydraulic oil with a maximum discharge quantity.

The above description referring to FIG. 6, which is applied to the case where the left operating lever is singly operated in the arm closing direction, is likewise applied to the case where the left operating lever is singly operated in the arm opening direction, the counterclockwise swing direction, or the clockwise swing direction or the case where the right operating lever is singly operated in the boom raising direction, the boom lowering direction, the bucket closing direction, or the bucket opening direction. The above description is also likewise applied to the case where the travel lever is singly operated in the forward traveling direction or the backward traveling direction. Furthermore, the above description is also likewise applied to the case where a complex operation with one or more devices of the operating device 26 is performed. In this case, the controller 30 may be configured such that the amount of shift of the upper end point A including ΔP1 and ΔP2 differ between when the left operating lever is singly operated and when the right operating lever is singly operated. The same is the case with the amount of shift of the lower end point B including ΔP3 and ΔP4. The controller 30 may also be configured such that the amount of shift of the upper end point A differs between when the left operating lever is singly operated in the arm closing direction and when the left operating lever is singly operated in the arm opening direction. The same is the case with the amount of shift of the lower end point B. The controller 30 may also be configured such that the amount of shift of the upper end point A differs between when a single operation is performed and when a complex operation is performed. The same is the case with the amount of shift of the lower end point B.

As described above, the shovel 100 according to an embodiment of the present invention, includes the lower traveling structure 1, the upper swing structure 3 mounted on the lower traveling structure 1, the engine 11 mounted on the upper swing structure 3, the main pump 14 serving as a hydraulic pump configured to be driven by the engine 11, a hydraulic actuator, the operating device 26 to operate the hydraulic actuator, and the controller 30 serving as a control device that controls the discharge quantity of the main pump 14 through negative control. The controller 30 is configured to change a control characteristic of the negative control according to the details of an operation on the operating device 26.

This configuration enables the shovel 100 to more flexibly control the discharge quantity of the main pump 14. As a result, for example, when the left operating lever is operated in the arm closing direction with the inching operation during leveling work, the shovel 100 can slowly increase the discharge quantity of the main pump 14 over a wide range of the amount of lever operation according as the amount of lever operation increases, compared with the case where the control characteristic of the negative control is fixed. Therefore, the operator of the shovel 100 can achieve fine movements of the arm 5 as intended.

The operating device 26 is typically an operating lever such as the left operating lever, the right operating lever, the left travel lever, or the right travel lever. The control characteristic of the negative control when the full lever operation is performed on the operating lever is adjusted to be different from the control characteristic of the negative control when the half lever operation is performed on the operating lever, for example.

As a result, for example, when the left operating lever is operated in the arm closing direction with the half lever operation during leveling work, the shovel 100 can reduce the bleed flow rate Qb, which is the flow rate of hydraulic oil discharged to the hydraulic oil tank T1 without flowing into the arm cylinder 8, without reducing the cylinder flow rate Qc, which is the flow rate of hydraulic oil flowing into the arm cylinder 8, compared with the case where the control characteristic of the negative control is fixed.

Furthermore, for example, when the operating lever is operated in the arm closing direction with the full lever operation during leveling work, the shovel 100 can more reliably maximize the discharge quantity of the main pump 14 than in the case where the control characteristic of the negative control is fixed. This is because the set value of the control pressure Pn corresponding to the upper end point A, which is a point defining the upper end of the inclined line GL, is adjusted to be greater than the back pressure.

The control characteristic of the negative control is, for example, determined by the inclined line GL that represents the correspondence between the control pressure Pn, which is the pressure of hydraulic oil on the upstream side of the throttle 18 placed in the center bypass oil passage 40, and the command value Qn for the discharge quantity of the main pump 14. Desirably, the controller 30 is configured such that the position of at least one of the upper end point A and the lower end point B of the inclined line GL is variable.

Specifically, the upper end point A of the inclined line GL may be configured to change in the direction of the horizontal axis according as the arm closing pilot pressure (the amount of lever operation) changes as illustrated in FIG. 4, for example. The upper end point A may also be configured to change its position in the direction of the vertical axis as well.

The lower end point B of the inclined line GL may be configured to change in the direction of the horizontal axis according as the arm closing pilot pressure (the amount of lever operation) changes as illustrated in FIG. 5, for example. The lower end point B may also be configured to change its position in the direction of the vertical axis as well.

Both of the upper end point A and the lower end point B of the inclined line GL may be configured to change in the direction of the horizontal axis according as the arm closing pilot pressure (the amount of lever operation) changes as illustrated in FIG. 6, for example. Both of the upper end point A and the lower end point B may also be configured to change their positions in the direction of the vertical axis as well.

The set value of the control pressure Pn corresponding to the upper end point A of the inclined line GL is desirably variable and set to be higher than the back pressure, which is the pressure of hydraulic oil on the downstream side of the throttle 18. This setting enables the shovel 100 to prevent the discharge quantity of the main pump 14 from being unnecessarily restricted when the left operating lever is operated in the arm closing direction with the full lever operation during leveling work, for example. That is, the shovel 100 can derive the command value Qn corresponding to the true control pressure Pn determined by the bleed flow rate Qb even when the minimum value of the control pressure Pn is determined not by the bleed flow rate Qb, which is the flow rate of hydraulic oil passing through the throttle 18, but by the back pressure.

The set value of the control pressure Pn corresponding to the upper end point A when the travel lever is operated with the full lever operation may be configured to be greater than the set value of the control pressure Pn corresponding to the upper end point A when the left operating lever is operated in the arm closing direction or the arm opening direction with the full lever operation. This is because the back pressure when a hydraulic motor is singly driven is typically greater than the back pressure when a hydraulic cylinder is singly driven.

The position of at least one of the upper end point A and the lower end point B of the inclined line GL desirably changes as the amount of operation of the operating device 26 changes. In this case, the amount of shift of the position of at least one of the upper end point A and the lower end point B of the inclined line GL that changes according as the amount of operation of an operating device included in the operating device 26 changes is adjusted to be different from the amount of shift of the position of at least one of the upper end point A and the lower end point B of the inclined line GL that changes according as the amount of operation of another operating device included in the operating device 26 changes.

For example, the amount of shift of the upper end point A of the inclined line GL that changes according as the amount of lever operation of the left operating lever, which is an operating device included in the operating device 26, in the arm closing direction changes is adjusted to be different from the amount of shift of the upper end point A of the inclined line GL that changes according as the amount of lever operation of the right operating lever, which is another operating device included in the operating device 26, in the boom raising direction changes. The same is the case with the lower end point B.

Furthermore, the amount of shift of the upper end point A of the inclined line GL that changes according as the amount of lever operation of the left operating lever in the arm closing direction changes may be adjusted to be different from the amount of shift of the upper end point A of the inclined line GL that changes according as the amount of lever operation of the left operating lever in the arm opening direction changes. The same is the case with the lower end point B.

An embodiment of the present invention is described above. The present invention, however, is not limited to the above-described embodiment. Various variations, substitutions, etc., may be applied to the above-described embodiment without departing from the scope of the present invention. Furthermore, the individual features described with reference to the above-described embodiment may be suitably combined to the extent that no technical contradiction is caused.

For example, the inclined line GL, which is a straight line segment that connects the upper end point A and the lower end point B according to the above-described embodiment, may be a polygonal chain connecting the upper end point A and the lower end point B with two or more bending points, may be a curve connecting the upper end point A and the lower end point B, and may be a combination of a straight line and a curve connecting the upper end point A and the lower end point B.

Furthermore, the energy saving control part 30B, which is configured to define the inclined line GL by determining the position of the upper end point A and the position of the lower end point B according to the above-described embodiment, may also be configured to define the inclined line GL by determining one or more other points.

Furthermore, according to the above-described embodiment, the energy saving control part 30B is configured to change the position of at least one of the upper end point A and the lower end point B based on a pilot pressure detected by the operating pressure sensor 29. The energy saving control part 30B may also be configured to change the position of at least one of the upper end point A and the lower end point B based on a pilot pressure detected by the operating pressure sensor 29 and the detection value of a back pressure sensor that detects the back pressure. The back pressure sensor is, for example, a pressure sensor that detects, as the back pressure, the pressure of hydraulic oil in an oil passage section on the downstream side of the throttle 18, namely, the oil passage section between the throttle 18 and the oil passage 43, in the center bypass oil passage 40. The energy saving control part 30B may also shift the position of the upper end point A such that the set value of the control pressure Pn corresponding to the upper end point A is higher than the back pressure, based on the detection value of this back pressure sensor.

What is claimed is:

1. A shovel comprising:

a lower traveling structure;

an upper swing structure mounted on the lower traveling structure;

an engine mounted on the upper swing structure;

a hydraulic pump configured to be driven by the engine;

a hydraulic actuator;

an operating device configured to operate the hydraulic actuator; and a hardware processor configured to control a discharge quantity of the hydraulic pump through negative control and change a control characteristic of the negative control according to details of an operation on the operating device, wherein the control characteristic of the negative control is determined by an inclined line that represents a correspondence between a control pressure and a command value for the discharge quantity of the hydraulic pump, the control pressure being a pressure of hydraulic oil on an upstream side of a throttle placed in a center bypass oil passage, an upper end point of the inclined line is expressed by a maximum command value that is an upper limit of the command value and a first set pressure of the control pressure of the negative control, a lower end point of the inclined line is expressed by a minimum command value that is a lower limit of the command value and a second set pressure of the control pressure of the negative control, and the hardware processor is configured to perform at least one of:

changing a position of the upper end point by varying the first set pressure with the command value being fixed at the maximum command value; and changing a position of the lower end point by varying the second set pressure with the command value being fixed at the minimum command value.

2. The shovel as claimed in claim 1, wherein the operating device is an operating lever, and the control characteristic of the negative control when a full lever operation is performed on the operating lever is different from the control characteristic of the negative control when a half lever operation is performed on the operating lever.

3. The shovel as claimed in claim 1, wherein a value of the first set pressure is set to be higher than a back pressure that is a pressure of hydraulic oil on a downstream side of the throttle.

4. The shovel as claimed in claim 1, wherein the hardware processor is configured to perform the at least one of changing the position of the upper end point and changing the position of the lower end point according as an amount of operation of the operating device changes, and an amount of shift of at least one of the position of the upper end point and the position of the lower end point that changes according as an amount of operation of one operating device included in the operating device changes is different from an amount of shift of the at least one of the position the upper end point and the position of the lower end point that changes according as an amount of operation of another operating device included in the operating device changes.

* * * * *